US008459933B1

(12) United States Patent
Liang

(10) Patent No.: US 8,459,933 B1
(45) Date of Patent: Jun. 11, 2013

(54) TURBINE VANE WITH ENDWALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 721 days.

(21) Appl. No.: 12/726,458

(22) Filed: Mar. 18, 2010

(51) Int. Cl.
*F01D 5/14* (2006.01)

(52) U.S. Cl.
USPC ..... 415/115; 415/139

(58) Field of Classification Search
USPC ..... 415/115, 191, 193, 199.1, 199.4, 415/199.5, 208.1, 208.2, 209.1, 209.4, 210.1, 415/211.2; 277/411–412, 417–420
See application file for complete search history.

(56) References Cited

U.S. PATENT DOCUMENTS 4,767,260 A * 8/1988 Clevenger et al. ..... 415/115

* cited by examiner

*Primary Examiner* — Edward Look
*Assistant Examiner* — Juan G Flores
(74) *Attorney, Agent, or Firm* — John Ryznic

(57) ABSTRACT

A stator vane assembly with a mate face gap and a seal slot to receive a seal pin. The seal pin includes a row of axial cooling air channels opening on a top side of the seal pin and extending toward a forward end of the seal pin, and a row of metering holes that supply cooling air from the gap below the seal pin to each of the axial cooling channels. Cooling air flows through the metering holes and along the axial cooling channels to provide cooling for the endwall mate face surfaces and the top of the seal pin exposed to a hot gas flow in the gap. Vortex chambers are formed on the forward ends of the seal pin mate face slots, and cooling air holes discharge cooling air from the vortex chambers downward from the vane leading edge corner.

11 Claims, 5 Drawing Sheets

A-A

TURBINE VANE WITH ENDWALL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane with endwall leading edge corner cooling.

2. Description of the Related Art Including Information Disclosed Under 37 CFR 1.97 and 1.98

A gas turbine engine, such as an industrial gas turbine (IGT) engine, includes one or more rows of stator vanes that react with a hot gas stream to redirect the stream into an adjacent row of rotor blades. The first stage stator vanes are exposed to the highest temperatures, and therefore require the most amount of cooling.

FIG. 1 shows a side view of a stator vane with a bow wave effect in front of the vane. A bow wave driven hot gas flow ingestion is created when the hot gas core flow 10 enters the vane row and the leading edge of the vane induces a local blockage which creates a circumferential pressure variation at the intersection of the airfoil leading edge location. The leading edge of the vane generates upstream pressure variations which can lead to hot gas ingress 11 into the front portion of the mate-face gap. If proper cooling or design measures are not undertaken to prevent this hot gas ingress, the hot gas ingress can lead to severe damage to the front edges of the vane endwalls as well as to the sealing material or mate-face in-between vane endwalls.

As seen in FIG. 1, this bow wave effect appears ahead of the turbine vanes. The high pressure ahead of the vane leading edge is greater than the pressure inside of a cavity or gap formed between adjacent vane mate-faces. This leads to a radially inward flow of the hot gas into the cavity. The ingested hot gas flows through the gap circumferentially inside the cavity and towards the lower pressure zones. The ingested hot gas then flows out at the points where the cavity pressure is higher than the local hot gas pressure. FIG. 2 shows a top view of a pair of vanes where the hot gas ingestion flows into the vane mate-face gap. the bow wave effect forces the much of the hot gas stream off of the leading edge of the vane and downward and into the gap of the adjacent vane mate-face along the suction side of the vane endwall and causes the most damage. FIG. 3 shows areas of distress for a vane leading edge corner where cooling is needed to address this hot gas ingression issue. TBC spallation 14, cracking 15 and erosion of the honeycomb 16 below the endwall are indicated in this figure.

In general, the size of the bow wave is a strong function of the vane leading edge diameter and distance of the vane leading edge to the endwall edge. Since the pressure variation in the tangential direction with the gap is sinusoidal, the amount of hot gas flow penetrating the axial gap increases linearly with the increasing axial gap width. Thus, it is important to reduce the axial gap width to the minimum allowable by tolerance limits in order to reduce the hot gas ingress.

BRIEF SUMMARY OF THE INVENTION

A stator vane mate-face seal for a gas turbine engine, the mate-face seal including axial flowing open cooling channels on a top side of the seal, and radial cooling air supply metering holes that open into the axial channels on a downstream end of the channels to provide cooling air to the seal channels and thus protect the mate-face and the seal from erosion due to the hot gas ingression from the bow wave effect. The seal also extends into the slots on the adjacent mate-faces and the axial cooling channels extend along the seal to also provide cooling for the vane endwalls in the mate-face areas.

The cooling air is discharged on the upstream end of the mate-face seal to provide film cooling for the seal within the mate-face gap for protection against the hot gas stream. for the seal portions that are inside the slots of the mate-face, the cooling air is discharged into a vortex flow forming cavity formed between the seal end and the slot, where the cooling air discharged from the axial cooling channels will flow into the vortex chamber and then discharged through a row of film cooling holes and into a cavity formed between the vane endwall and an adjacent rotor blade platform.

DETAILED DESCRIPTION OF THE INVENTION

To provide cooling for the vane mate-faces and the mate-face seal that seals a gap formed between adjacent vanes endwalls and thus prevent the erosion of the endwalls described above, the applicant has designed a new mate-face seal (referred to as a seal pin in the prior art which is a flat solid rectangular piece of metal) with a cooling circuit to provide cooling for the mate-face seal pin and the sections around the vane endwalls in which the mate-face seal pin is located. The mate-face seal pin is a seal placed within adjacent slots between adjacent vane endwalls in which a gap is formed between the adjacent endwalls that changes in length due to thermal effects of the metal material.

Figure 1:
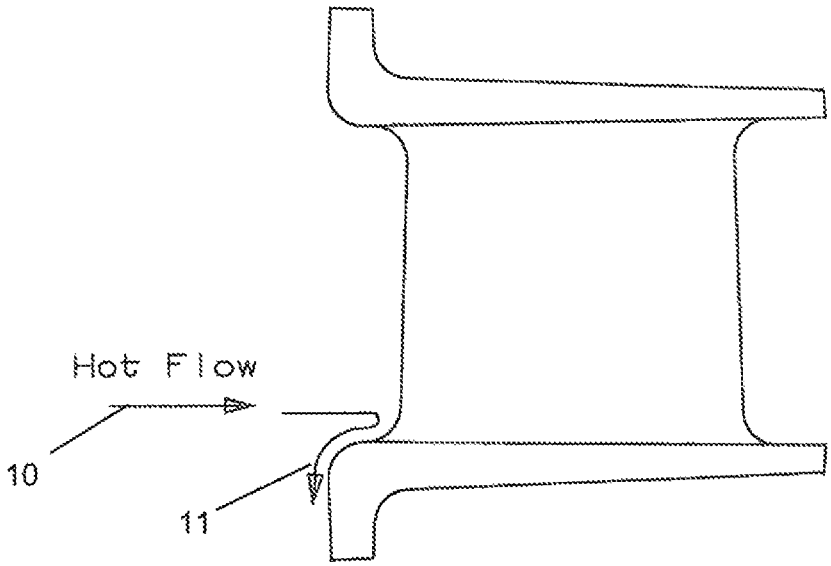
FIG. 1 shows a turbine stator vane with a bow wave effect displayed in front of the vane at the inner diameter endwall.
Figure 2:
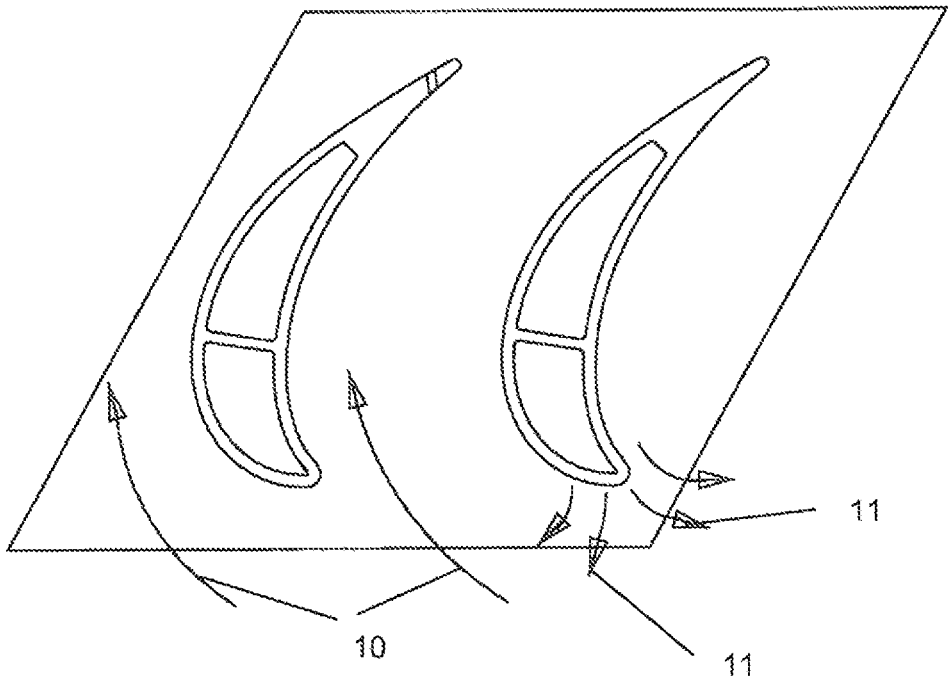
FIG. 2 shows a top view of a pair of vanes with the hot gas ingestion into the mate-face gap.
Figure 3:
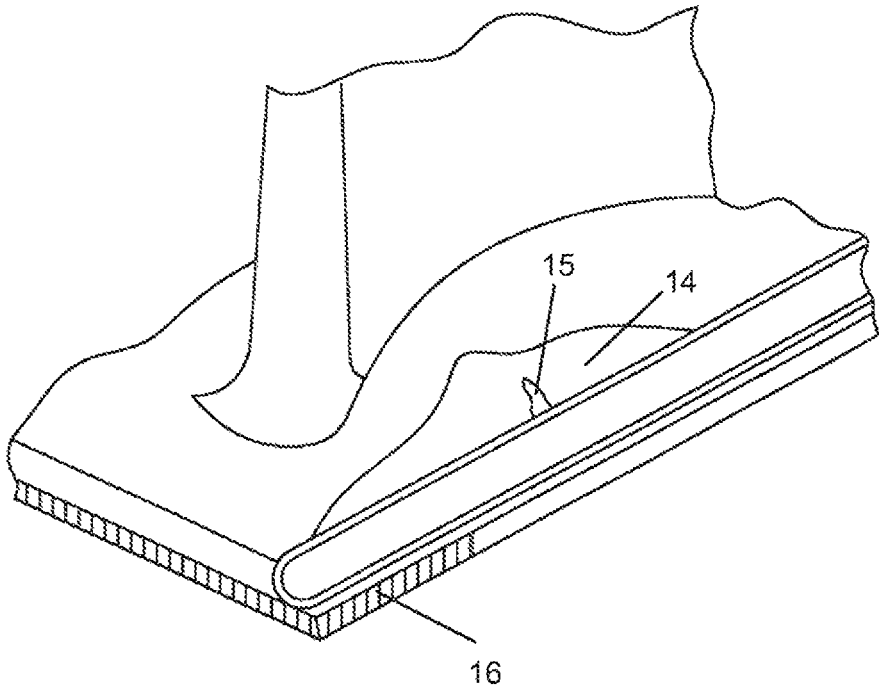
FIG. 3 shows a vane endwall with locations of damage caused by the hot gas ingression on the endwall and the mate-face of the vane.
Figure 4:
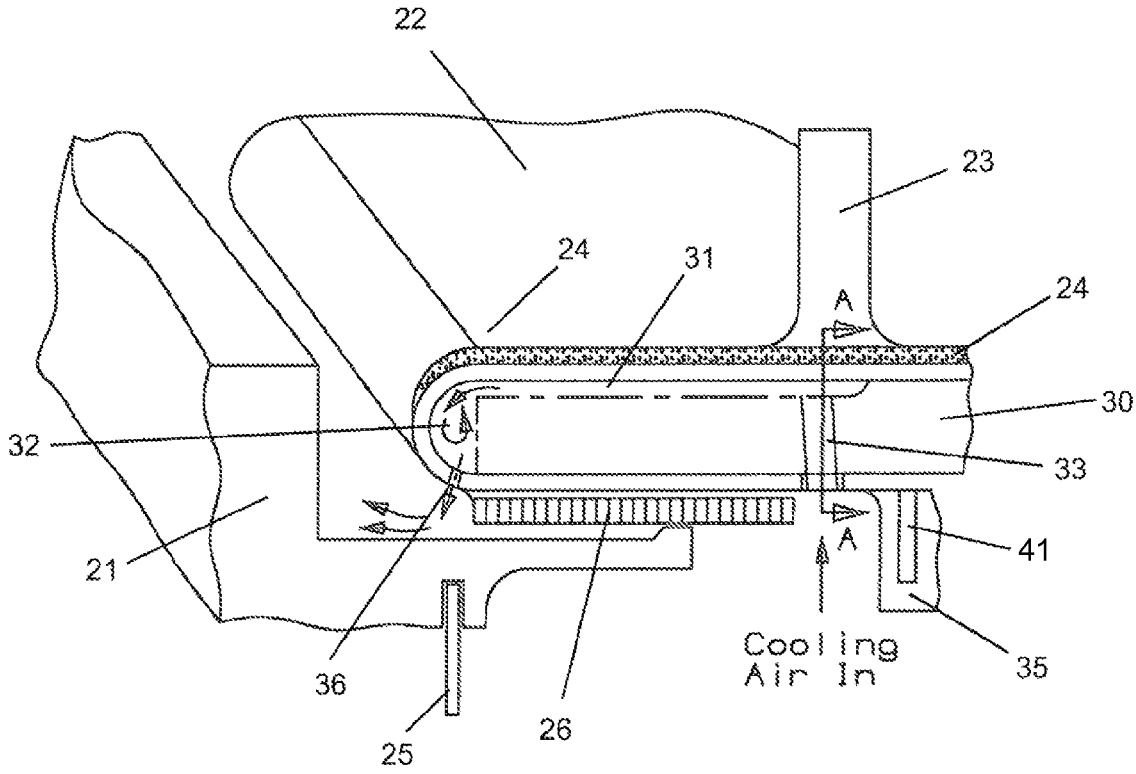
FIG. 4 shows a cross section view of an endwall leading edge corner cooling circuit of the present invention.

FIG. 4 shows a cross section side view of a vane endwall 22 with an airfoil 23 extending upward from the endwall 2, and a rotor blade 21 located adjacent to the vane endwall 22 that forms a rotary seal with a honeycomb structure 26 attached to an underside of the vane endwall 22. The vane endwall includes a rail 35 with a seal groove 41 therein. A cover plate 25 extends from the rotor blade finger seal. The vane mate-face includes a slot in which a mate-face seal pin 30 is placed. A TBC 24 is applied over the endwall surfaces.

Figure 5:
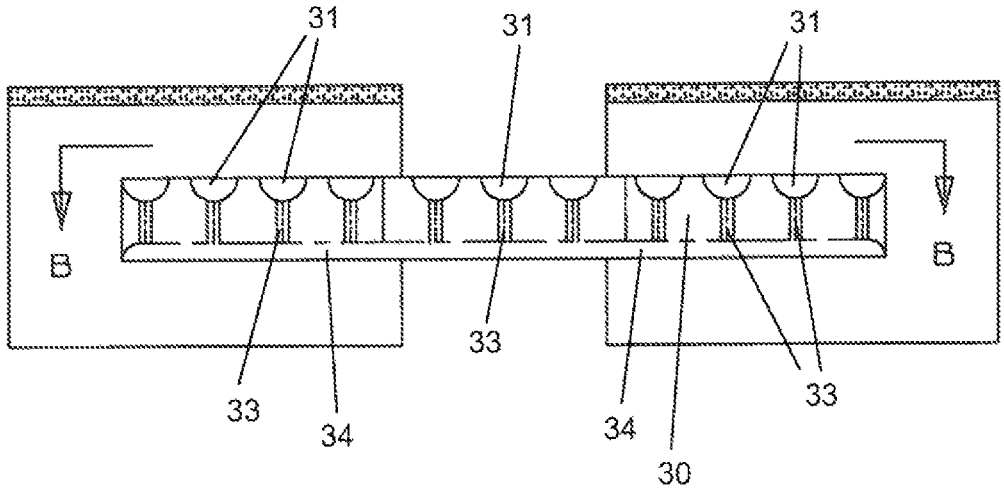
FIG. 5 shows a front view of two adjacent mate-faces with a seal pin within the mate-face gap of the present invention.

A cooling air cavity is located below the endwall and supplies cooling air to the mate-face seal pin 30. The mate-face seal pin includes a row of metering holes 33 that open into the cooling air cavity on the bottom, and open into rows of axial cooling air channels that open onto a top surface of the mate-face seal pin 30. FIG. 5 shows a cross section view of the mate-face seal pin 30 through the line A-A in FIG. 4. FIG. 5 shows the rows of axial cooling air channels 31 opening on the top surface of the seal pin 30 with a metering hole 33 opening into each axial flow channel 31. As seen in FIG. 5, the axial flow cooling channels 31 extend across the entire top surface from side to side. Two adjacent mate-faces each with a slot are shown in FIG. 5. The gap between the two mate-faces is shown above the seal pin 30 and the cooling air cavity is shown below the seal pin 30. Local cooling supply channels 34 are formed on the bottom surface of the seal pin 30 to channel cooling air from the cooling cavity to the metering holes 33 that are contained within the two slots of the mate-faces.

As seen in FIG. 4, cooling air flows up through the metering holes 33 that open into the gap and then flows down the axial cooling air channels 31 toward the leading edge or toward the left side in this figure. At the surface of the mate-face and the seal pin 30, the hot gas flows opposite to the main gas stream because of the bow wave effect. Thus, for the axial flow cooling air channels 31 that open into the gap between the adjacent mate-faces, the hot gas flow will aid in the cooling air flow through the axial channels 31.

Figure 6:
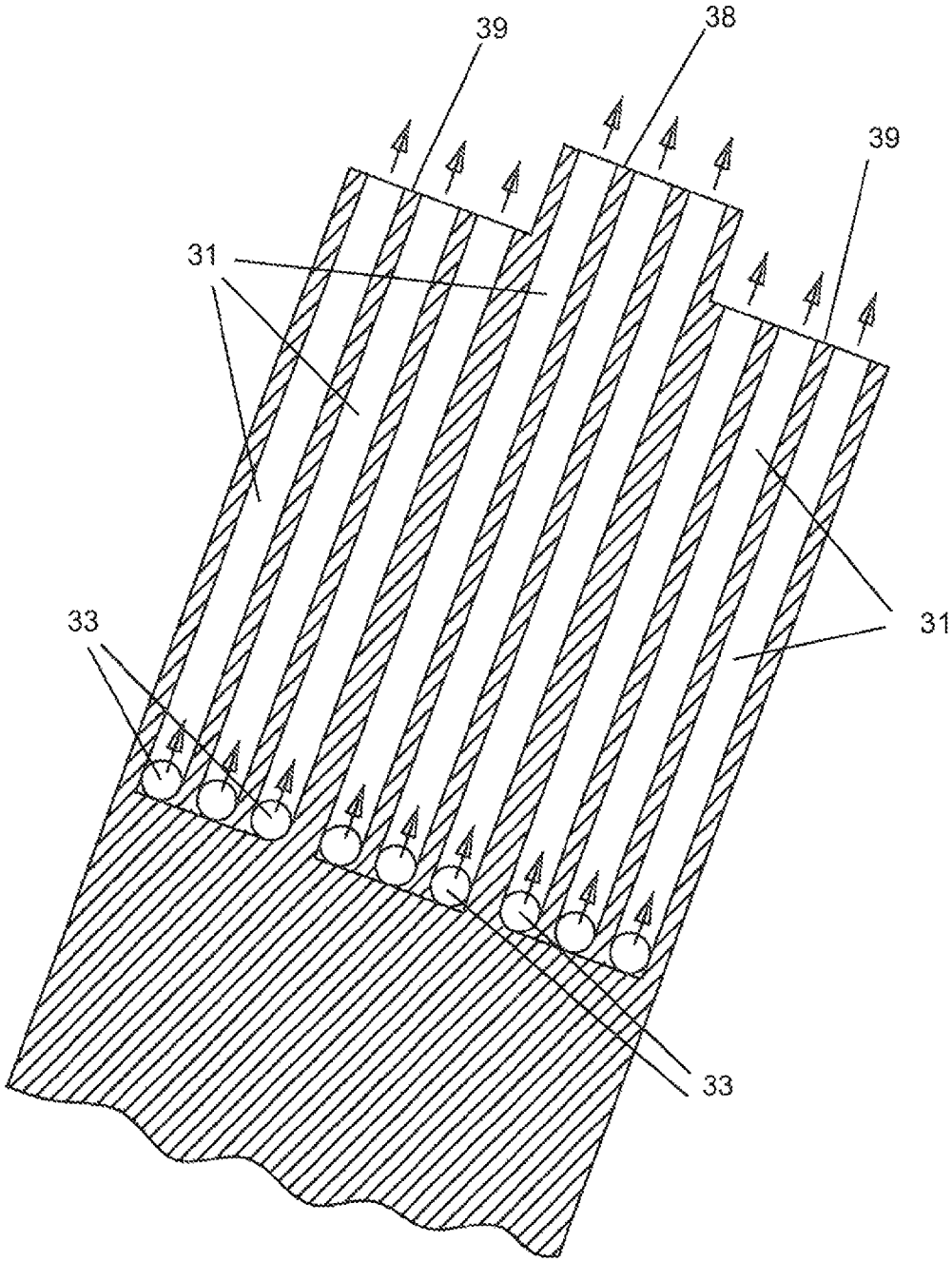
FIG. 6 shows a top view of the seal pin with metering and cooling channels of the present invention.

As seen in FIG. 6, the top view of the seal pin includes the axial flow cooling channels 31 extending from the metering holes 33 toward the forward end where the seal section that is within the gap extends further 38 that the seal pin section 39 covered by the slots within the mate-faces. The shorted seal pin sections 39 end at a distance from the ends of the slot within the mate-face and form the vortex chamber 32 on the forward end of the mate-faces. The cooling air that flows along these shortened axial flow cooling channels is discharged into the vortex chambers 32 to form a vortex flow. The axial flow channels 31 in the lengthened section 38 of the seal pin extends out and into the gap at about the same spacing as the forward end of the mate-faces, where the cooling air then flows down an under the seal pin 30 within the gap toward the aft end of the seal pin.

The axial cooling channels 31 on the seal pin covered within the mate-face slots will also provide cooling for the vane endwall leading edge corners. Cooling air is supplied form the endwall inner cavity and through the metering holes and into the axial cooling channels with the space formed between the seal pin and the upper surface of the mate-face slots. This will generate a backside convection cooling for the metal above the seal slots. A majority of the spent cooling air is discharged into the vane leading edge mate-face gap cavity at an offset location. This spent cooling air will generate a vortex flow within the cavity for the vane airfoil leading edge to provide additional cooling for the endwall corner. The spent cooling air is then discharged through a row of cooling holes located in front of the honeycomb surface to provide dilution for an incoming hot gas stream. In addition, for sealing the gap in-between the two vanes, the metering cooling channels also provide convective cooling for the seal pin as well as a buffer air for the rim cavity in-between the vane and the adjacent blade. The combined effects of convective cooling and spent air discharged into the mate-face gap will lower the heat load on the endwall edges and the metal temperature for the vane endwall.

I claim the following:

1. A seal pin for a mate-face seal of a turbine stator vane endwall, the seal pin comprising:

an upper surface and a bottom surface;

a forward end and an aft end;

a row of metering holes in a forward section of the seal pin a connecting the upper surface to the bottom surface of the seal pin;

a row of axial flow cooling channels opening onto the upper surface of the seal pin; and, the row of axial flow cooling channels connected to and extending from the row of metering holes such that cooling air from below the bottom surface will flow into the axial flow cooling channels.

2. The seal pin of claim 1, and further comprising:

the forward end of the seal pin includes a middle section that extends out further than the two sides adjacent to the middle section.

3. The seal pin of claim 1, and further comprising:

local cooling supply channels on the bottom surface that connect the metering holes and axial flow cooling channels in the outer sides of the seal pin that will be covered by a seal slot formed within a vane endwall mate-face.

4. The seal pin of claim 1, and further comprising:

the row of metering holes are located along the seal pin around where a leading edge of the vane airfoil is located on the vane endwall.

5. A stator vane assembly for a gas turbine engine, the stator vane assembly comprising:

a first stator vane with a first endwall having a first mate face and a first mate face slot;

a second stator vane with a second endwall having a second mate face and a second mate face slot;

the first and second mate face slots being opposed to each other and forming a gap between the first and second mate faces;

a seal pin secured within the first and second mate face slots;

the seal pin having a row of metering holes opening on a bottom side of the seal pin and connected to the gap; and, the seal pin having a row of axial cooling air channels connected to the row of metering holes and extending toward a forward end of the seal pin, the row of cooling air channels opening onto a top side of the seal pin so that cooling air from the gap below the seal pin will be metered through the metering holes and flow along the cooling air channels to provide cooling to the seal pin and the first and second endwalls along the first and second mate faces.

6. The stator vane assembly of claim 5, and further comprising:

the seal pin includes a middle section that extends out further that the two sections on the side of the middle section.

7. The stator vane assembly of claim 6, and further comprising:

the extended middle section of the seal pin covers over the gap between the first and second mate faces.

8. The stator vane assembly of claim 5, and further comprising:

first and second vortex chambers formed between the forward end of the seal pin and the first and second mate face slots.

9. The stator vane assembly of claim 8, and further comprising:

the first and second endwalls both include a cooling air discharge hole connected to the vortex chamber and directed to discharge cooling air downward from a vane leading edge corner.

10. The stator vane assembly of claim 5, and further comprising:

the row of metering holes extends across the seal pin from one side to the opposite side; and, the row of metering holes are positioned at an axial location of around where the vane leading edge on the vane platform is located.

11. The stator vane assembly of claim 5, and further comprising:

one metering hole is associated to one axial cooling air channel.

* * * * *